United States Patent [19]

LaFever et al.

[11] 4,392,407

[45] Jul. 12, 1983

[54] MACHINE GUN AMMUNITION LOADING SYSTEM

[75] Inventors: Clifford E. LaFever, Mission Viejo; John H. Peck, Fountain Valley, both of Calif.

[73] Assignee: The United States of America as represented by the Secretary of the Army, Washington, D.C.

[21] Appl. No.: 296,737

[22] Filed: Aug. 27, 1981

[51] Int. Cl.[3] ..... F41D 10/14

[52] U.S. Cl. ..... 89/33 BB; 89/34

[58] Field of Search ..... 89/33 R, 33 B, 33 BB, 89/33 C, 34

[56] References Cited

U.S. PATENT DOCUMENTS 2,401,762 6/1946 Irasek ..... 89/34

3,955,469 5/1976 Conley ..... 89/33 BB

*Primary Examiner*—Stephen C. Bentley

*Assistant Examiner*—Maureen T. Ryan

*Attorney, Agent, or Firm*—Robert P. Gibson; Anthony T. Lane; Max Yarmovsky

[57] ABSTRACT

A machine gun ammunition loading system employs cantilevered support members on a magazine holding a leading round of belted ammunition supported above a cover of the magazine. The cover of the magazine includes mating parts which permit sliding engagement below the machine gun. When fully mated, the cantilevered members, with the leading round between them, are inserted into the receiver in a loading position from whence charging can be performed by single-handed motion of an operator while upright and walking.

6 Claims, 2 Drawing Figures

MACHINE GUN AMMUNITION LOADING SYSTEM

GOVERNMENT INTEREST

The invention described herein was made in the course of a contract with the Government and may be manufactured, used and licensed by or for the Government for governmental purposes without the payment to use of any royalties thereon.

BACKGROUND OF THE INVENTION

The capacity of a magazine on an automatic weapon places a constraint on the number of rounds which may be fired between reloading operations. Magazines for hand-carried weapons have generally been limited by the weight of the magazine and its contained rounds to spring-load magazines having a capacity of a few dozen rounds.

The recent trend to smaller and lighter ammunition such as, for example, 5.56 mm cartridges, permits a single operator to carry enough ammunition mounted on the weapon to make belt-type feed very attractive if it could be readily loaded by an upright walking operator carrying the weapon. Since one of the operator's hands is occupied supporting the weapon, any reloading operation must be accomplished by his single remaining hand. Furthermore, besides mounting the ammunition, it should be made ready for firing preferably by the mere act of mounting the magazine containing the ammunition on the weapon.

Linked belt fed machine gun systems in the prior art have required one or two separate additional actions by the operator in order to load. These additional actions consisted of pulling, pushing or otherwise positioning the leading portion of an ammunition belt by hand into a specific part of the weapon mechanisms. Ordinarily, these systems additionally required at least one further action by the operator such as, for example, holding the leading portion of the belt in its proper position by closing a door or by otherwise engaging a latching or holding mechanism prior to being ready to charge and fire. Such additional acts prevented the rapid mounting and firing of linked belt ammunition by an upright operator carrying the weapon. That is, these additional operations require two hands. Since one hand of the erect walking operator is engaged in carrying the weapon, he was not able to perform the additional acts without laying the weapon down.

OBJECTS AND SUMMARY OF THE INVENTION

Accordingly, it is an object of the present invention to provide a machine gun ammunition loading system which overcomes the drawbacks of the prior art.

It is a further object of the invention to provide a machine gun ammunition loading system which permits loading, charging, readying the weapon for firing with one hand in a matter of seconds by an operator standing upright even while walking.

It is a further object of the invention to provide a machine gun ammunition loading system which includes apparatus for maintaining a leading round of a linked ammunition belt in a position which is inserted into a receiver of a machine gun in a position which permits charging of the leading round without further acts beyond sliding the magazine into the weapon.

According to an aspect of the present invention, there is provided a machine gun ammunition loading system comprising a machine gun having a loading position and a charging position, a magazine for containing belted rounds including a leading round, mating means on the magazine and the machine gun for sliding engagement of the magazine with the machine gun, a receiver in the machine gun, cantilevered means on the magazine for holding and positioning the leading round, the cantilevered means and the leading round being inserted to the loading position by the sliding engagement, a feed pawl movable between first and second positions in the receiver, the feed pawl in its first position being engageable with the leading round in its loading position, and the feed pawl being operative when moving from its first to its second position to displace the leading round from its loading position to its charging position.

According to a feature of the present invention, there is provided a machine gun ammunition loading system comprising a machine gun having first and second transverse slots therein, a magazine for containing belted rounds including a leading round having first and second tenons slideably engageable with the first and second slots and effective to support the magazine in a mated position on the machine gun, a receiver in the machine gun, a first cantilevered means on the magazine effective to guide and protect a nose portion of the leading round, a second cantilevered means on the magazine spaced from the first cantilevered means effective to guide and protect a butt portion of the leading round, resilient means on the magazine for resiliently applying force to the leading round, the force being effective to tend to hold the leading round in position in the first and second cantilevered means, a third slot in the resilient means, the first and second cantilevered means with the leading round supported therebetween entering the receiver and the leading round being disposed in a loading position when the magazine is supported in the mated position, a holding pawl in the receiver, the holding pawl being effective to prevent withdrawing the leading round from the loading position, a feed pawl movable by an action of the machine gun between first and second positions, and the feed pawl being engageable in its first position with the leading round in its loading position and effective when moving from its first to its second position to displace the leading round from its loading to a charging position whereby charging of the leading round is enabled.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
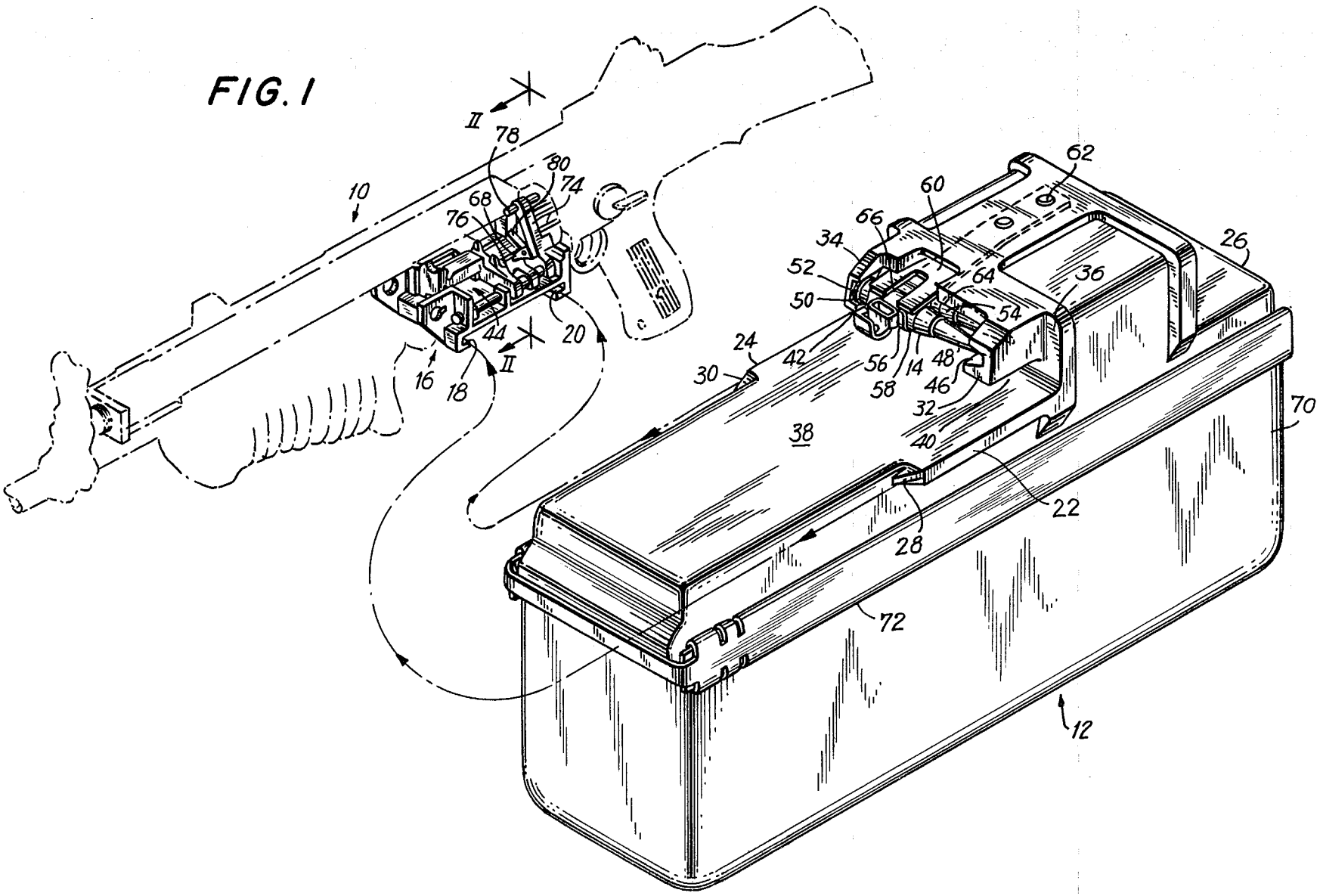
FIG. 1 is a perspective view, partially cut away of a machine gun and a magazine according to an embodiment of the present invention.

Referring now to FIG. 1, a machine gun 10 is adapted to use belted ammunition from a magazine 12. When magazine 12 is installed on machine gun 10 by a single one-handed motion, a leading round 14 is mated with a feed mechanism (not shown) of machine gun 10 so that leading round 14 can be charged and fired without the numerous other actions conventionally required.

Figure 2:
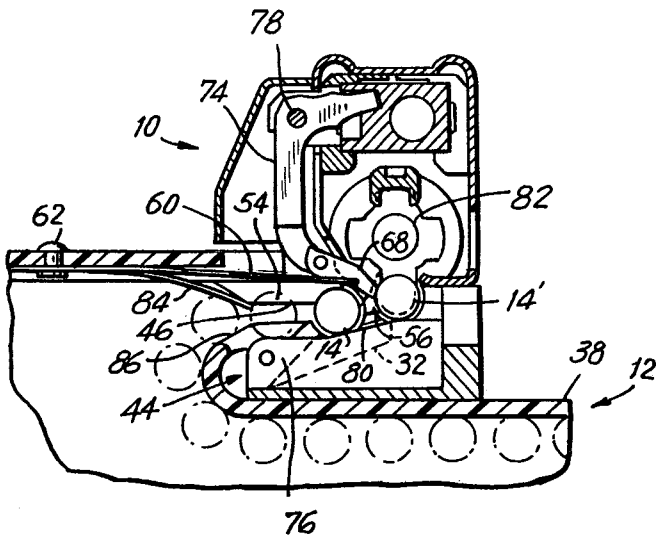
FIG. 2 is a cross section taken along II—II of FIG. 1.

Referring now also to FIG. 2, a lower receiver 16 of machine gun 10 includes first and second transverse slots 18 and 20 which are engaged by and support tenons 22 and 24 on a cover member 26 of magazine 12. Tenons 22 and 24 include tapered leading portions 28 and 30 for guiding tenons 22 and 24 into transverse slots 18 and 20. When tenons 22 and 24 are fully engaged in transverse slots 18 and 20, a latching mechanism (not shown) latches magazine 12 in the engaged position to machine gun 10.

A cantilevered nose protector and guide 32 and a cantilevered butt protector and guide 34 project in a direction parallel to tenons 22 and 24 from a stop wall 36 which projects upward from a planar surface 38 of cover member 26. Due to cantilevered nose and butt protectors and guides 32 and 34 being cantilevered over planar surface 38, slots 40 and 42 are created therebetween thus permitting cantilevered nose and butt protectors and guides 32 and 34 to be inserted into a receiver, shown generally at 44 of machine gun 10.

Cantilevered nose protector and guide 32 includes a longitudinal slot 46 therein generally shaped to guide and protect the nose of a slug 48. Similarly, butt protector and guide 34 includes a longitudinal slot 50 for guiding and protecting a butt end 52 of leading round 14 as well as following rounds, the first of which is shown at 54 linked to leading round 14 by any conventional means such as by brass links 56 partially encircling a cartridge portion 58.

A leaf spring 60 is affixed inside cover member 26 by any convenient means such as, for example, by rivets 62 and project over leading round 14 to press down on, and hold leading round 14 in position captured in longitudinal slots 46 and 50. This ensures that leading round 14 will remain in its ready position until drawn out of magazine 12 by the action of a feed mechanism in machine gun 10. A slot 66 in leaf spring 60 provides access to at least leading round 14 for advancement by a feed pawl 68 in machine gun 10.

A box-like container member 70 contains the major portion of the linked rounds forming a belt laid back and forth in layers therein. Cover member 26 and container member 70 may be of any convenient material which may be formed and which is suitable for withstanding the environment in which the apparatus is to be used. In a preferred embodiment of the invention, cover member 26 and container member 70 are preferably of plastic and more preferably of polypropylene plastic and most preferably of apolypropylene plastic containing an effective amount of glass fill.

Cover member 26 and container member 70 are held together by a clinched closure 72 preferably of metal.

Referring now specifically to FIG. 2 wherein a magazine 12 is fully mated in machine gun 10, and feed pawl 68 is shown moved to its most advanced position by a feed lever 74. As is conventional, feed pawl 68 is spring loaded into the position shown. Feed lever 74 is positioned to move feed pawl 68 back and forth in slot 66 (FIG. 1) in leaf spring 60. A holding pawl 76 in receiver 44 is spring loaded to engage the underside of leading round 14 to prevent it being withdrawn from machine gun 10.

Leaf spring 60, feed pawl 68 and a bottom portion of feed lever 74 hold leading round 14 and following rounds 54 during firing to maintain rigid control over the feed while the engagement portion of feed pawl 68 engages each round as it reaches the position of leading round 14 for moving it into chambering position 14'.

Conventional stripping apparatus for stripping link 56 may be employed. However, since this apparatus is conventional, it is neither shown nor described in detail.

When magazine 12 is inserted in machine gun 10, leading round 14 depresses holding pawl 76 during its passage to the position shown. Holding pawl 76 is thereupon urged into its elevated holding position shown after the passage of the widest part of leading round 14. During charging, feed lever 74 is rotated in the clockwise direction about a pivot 78 to draw feed pawl 68 leftward in FIG. 2 until it engages the left side of leading round 14. Feed lever 74 thereupon rotates in the counterclockwise direction about pivot 78 thus advancing feed pawl 68 to the position shown and advancing leading round 14 along a fixed feed ramp 80 into the charging position shown at 14'. Conventional charging apparatus (neither shown nor described) advance the round from the charging position 14' into the chamber.

The requirement that a charging operation must be performed to move leading round 14 to charging position 14' is a safety feature since the weapon cannot be fired until this charging operation is performed. This prevents inadvertently firing machine gun 10 during attachment of magazine 12 but permits rapid charging thereafter.

FIG. 2 is a cross section facing forward. Longitudinal slot 46 is shown. Tapered positioning guides 84 and 86 guide the nose of the slug into longitudinal slot 46.

Having described a specific preferred embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

We claim:

1. A machine gun ammunition loading system comprising:

a machine gun having a loading position and a charging position;

a magazine for containing belted rounds including a leading round;

mating means on said magazine and said machine gun for sliding engagement of said magazine with said machine gun;

a receiver in said machine gun;

cantilevered means on said magazine for holding and positioning said leading round, which includes;

a first cantilevered means for guiding a nose portion of said leading round and a second cantilevered means for guiding a butt portion of said leading round;

a resilient hold down means engaging said leading round and operative to resist displacement thereof from its position in said first and second cantilevered means;

said cantilevered means and said leading round being inserted to said loading position by said sliding engagement;

a feed pawl movable between first and second positions in said receiver;

said feed pawl in its first position being engageable with said leading round in its loading position; and said feed pawl being operative when moving from its first to its second position to displace said leading round from its loading position to its charging position.

2. A machine gun ammunition loading system according to claim 1, wherein said resilient hold down means includes a flat spring having a slot therein, said feed pawl engaging said leading round through said slot.

3. A machine gun ammunition loading system according to claim 1, wherein said machine gun includes a holding pawl, said holding pawl being engageable with said leading round in its loading position.

4. A machine gun ammunition loading system comprising:

a machine gun having first and second transverse slots therein;

a magazine for containing belted rounds including a leading round having first and second tenons slideably engageable with said first and second slots and effective to support said magazine in a mated position on said machine gun;

a receiver in said machine gun;

a first cantilevered means on said magazine effective to guide and protect a nose portion of said leading round;

a second cantilevered means on said magazine spaced from said first cantilevered means effective to guide and protect a butt portion of said leading round;

resilient means on said magazine for resiliently applying force to said leading round, said force being effective to tend to hold said leading round in position in said first and second cantilevered means;

a third slot in said resilient means;

said first and second cantilevered means with said leading round supported therebetween entering said receiver and said leading round being disposed in a loading position when said magazine is supported in said mated position;

a holding pawl in said receiver, said holding pawl being effective to prevent withdrawing said leading round from said loading position;

a feed pawl movable by an action of said machine gun between first and second positions; and said feed pawl being engageable in its first position with said leading round in its loading position and effective when moving from its first to its second position to displace said leading round from its loading to a charging position whereby charging of said leading round is enabled.

5. A machine gun ammunition loading system according to claim 4, wherein said feed pawl is movable in said third slot.

6. A machine gun ammunition loading system according to claim 5, wherein said resilient means includes a flat spring.

* * * * *